US007010005B1

(12) United States Patent
Smith

(10) Patent No.: US 7,010,005 B1
(45) Date of Patent: Mar. 7, 2006

(54) MINIMIZING HIGH POWER LASER THERMAL BLOOMING IN THE ATMOSPHERE

(76) Inventor: David C. Smith, 44 Candlelight Dr., Glastonbury, CT (US) 06033

( * ) Notice: Subject to any disclaimer, the term of this patent is extended or adjusted under 35 U.S.C. 154(b) by 328 days.

(21) Appl. No.: 10/370,906

(22) Filed: Feb. 20, 2003

(51) Int. Cl.
*H01S 3/82* (2006.01)

(52) U.S. Cl. ..... 372/24; 372/15

(58) Field of Classification Search ..... None
See application file for complete search history.

(56) References Cited

U.S. PATENT DOCUMENTS 4,862,468 A * 8/1989 Fink ..... 372/19
4,998,259 A * 3/1991 Chandra et al. ..... 372/68
5,533,268 A * 7/1996 Keightley ..... 33/290
6,061,164 A * 5/2000 Ikegame ..... 359/224

* cited by examiner

*Primary Examiner*—James Vannucci
(74) *Attorney, Agent, or Firm*—M. P. Williams

(57) ABSTRACT

The output of a high power pulsed or CW laser (22), which may be mounted on a vehicle (17) is reflected from a convex mirror (27) to a concave mirror (29) that is displaced radially outward on a rotating structure (14) from the convex mirror by at least two beam diameters so that each pulse emanates from a position around a circle which is displaced from adjacent pulses by at least the diameter of the beam, thereby to minimize thermal blooming, or the position of a CW output laser beam is slewed. Directing the beams so that all of them will converge at a target area which is a given range from the apparatus is achieved by moving the convex mirror axially in response to range control signals provided through brushes (47) and slip rings (46). The rotating structure (14) including the laser waveguide (24) is journaled by bearings (50, 51) for rotation by a gear in response to a pinion (34) and gear reduction (37) driven by a motor (38).

5 Claims, 2 Drawing Sheets

MINIMIZING HIGH POWER LASER THERMAL BLOOMING IN THE ATMOSPHERE

TECHNICAL FIELD

This invention relates to the minimizing of thermal blooming which results from a high power laser beam heating the atmosphere, such as in a laser weapon.

BACKGROUND ART

The use of high powered lasers as weapons is known. One of the major problems encountered with high powered laser beams in the atmosphere is an effect known as "thermal blooming". The effect is a result of the heating of the atmospheric elements along the path of the beam by the absorption of a small amount of the laser energy by the elements in the atmosphere. The heating causes differential phase changes at incremental positions along the beam path, which in turn causes the laser energy to become more widely dispersed. The heating and therefore the distortion of the beam is directly in the path of the laser beam and can be quite severe. The result is that at a target, the power per unit area (fluence) is smaller than that required to do the requisite amount of damage.

Continuous wave (CW) lasers suffer the most from thermal blooming, and therefore laser weapons generally are pulsed, with the pulse length chosen to be short compared with the time required for the thermal blooming distortion in the atmosphere.

When a train of pulses is used, thermal blooming caused by residual heating of previous laser pulses in the train creates what is called "overlap blooming". The repetition rate for a train of pulses is limited by the wind clearout time (the time required for cooling adequately between pulses) which can be determined to be the beam diameter, D, divided by the transverse wind velocity, V. In the prior art, the repetition rate for a train of laser pulses is on the order of three pulses per wind clearout time, 3/D/V.

If each pulse is made short enough, more fluence can be delivered with less blooming by each individual pulse. Increasing the power of each pulse is beneficial up to the point where there is gas breakdown or ionization of the air path, with a commensurate severe absorption of the laser energy by the breakdown plasma. Therefore, a single pulse is generally not sufficient for most missions.

When there is no wind to cool and disperse heat in the path of the laser beam, overlap of successive pulses and residual heating from prior pulses cause thermal blooming to be much more of a problem.

DISCLOSURE OF INVENTION

Objects of the invention include minimizing thermal blooming in the path of a high power laser beam in the atmosphere; increasing the fluence of a laser beam at a target, thereby to provide more interaction with the target (more damage); increasing the pulse rate of high power laser pulses transmittable through the atmosphere without thermal blooming; and an improved high power laser weapon.

According to the present invention, successive pulses of a high powered laser are emanated from mutually non-overlapping positions about a circle such that each pulse emerges into unheated atmosphere. According further to the invention, a rotatable mirror assembly is rotated in synchronism with high powered laser pulses so that the output mirror moves around a circle by more than the diameter of the laser pulse, between successive pulses.

In one form, the rotating mirror assembly comprises a convex mirror in line with a laser waveguide which reflects the laser beam to a concave mirror at the extreme of the rotating assembly, the concave mirror comprising the output mirror, the assembly being rotated in synchronism so that the output mirror is translated about the circle by more than the beam width for each successive pulse.

The invention separates successive beams, except in the vicinity of the target where they converge, so that thermal blooming is minimized. The invention is effective because thermal blooming is more severe at the inception of the transmission than it is in the vicinity of the target.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
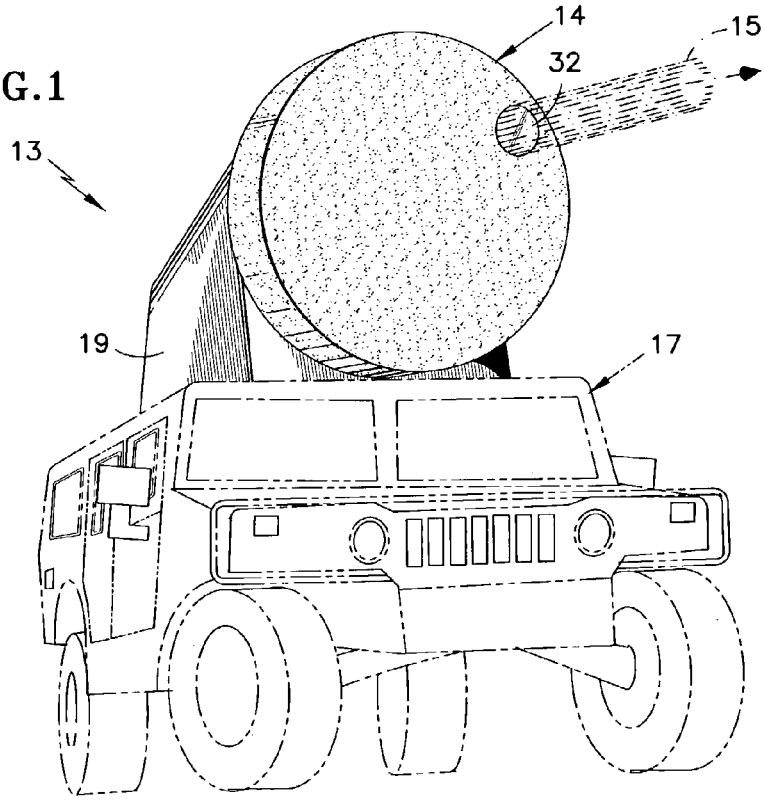
FIG. 1 is a simplified perspective of a vehicle having a laser system with a rotary optical antenna according to the invention.

Referring to FIG. 1, a laser system 13 having a rotary optical antenna 14 that controls spacing of successive radar pulses 15, is disposed on a military vehicle 17. The laser system 13 includes a housing 19 within which the laser, the apparatus for rotating the optical antenna 14, and range control apparatus are all housed.

Figure 2:
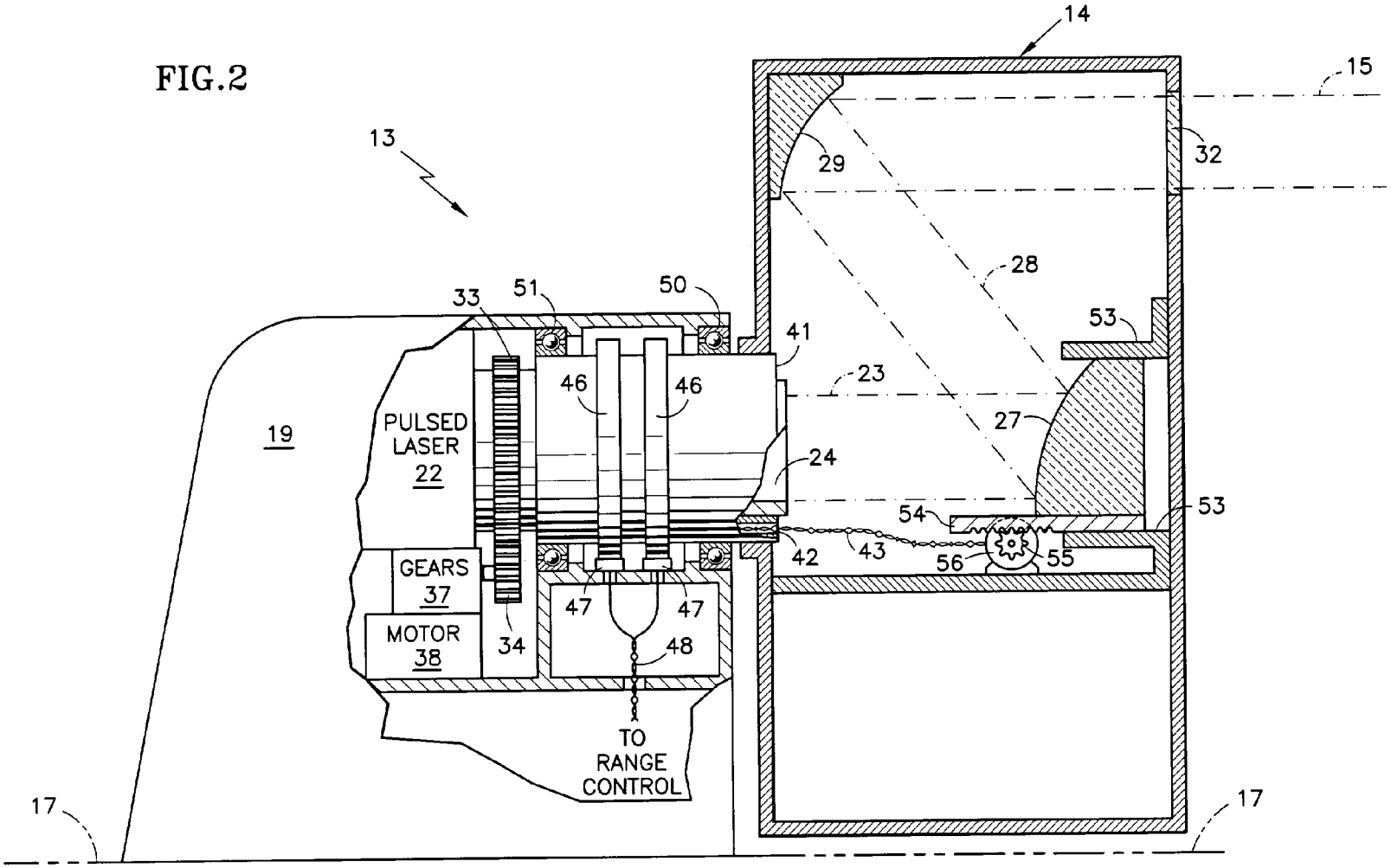
FIG. 2 is a partial, sectioned side elevation view of the antenna of FIG. 1.

In FIG. 2, a pulsed laser 22 provides a laser beam 23 through a circular waveguide 24. The beam impinges on a convex mirror 27 to provide a reflected beam 28 to a concave mirror 29. This in turn provides the output beam 15 through a nearly 100% transmissive window 32. The optical antenna 14 along with the circular waveguide 24 are rotated such as by means of a gear 33 driven by a pinion 34 which in turn is rotated through suitable gear reduction 37 by a motor 38. A cylinder 41, having a bore 42 therein to permit the passage of wires 43, is disposed about the circular waveguide 24. On the cylinder 41 are slip rings 46 which coact with brushes 47 to provide range control signals over a twisted pair of wires 48, through the slip rings 46 to the wires 43 which are connected to the slip rings. The rotating portions are suitably journaled to non-rotating structure within the housing 19 by suitable bearings 50, 51.

Typically, the laser may be a neodinium/Yag laser; however, other lasers may also benefit from the present invention. The range at which the various beams of successive pulses will converge at essentially a single spot of the beam diameter can be controlled by moving the convex mirror 27 closer to or away from the waveguide 24. This may be accomplished, for instance, by mounting the mirror 27 so that it can slide between suitable members 53 in response to movement of a rack 54 driven through a pinion 55 by a motor 56, which in turn is controlled by signals on the wires 43. The motor 56 could, for instance, be a stepping motor or it could be a null-seeking resolver of any known variety.

Figure 3:
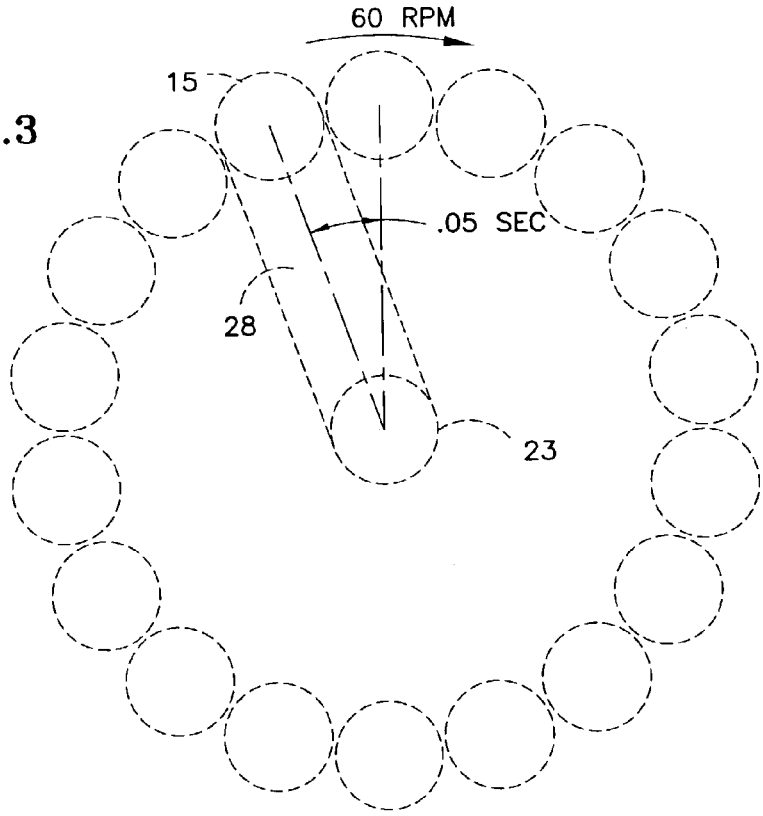
FIG. 3 is a stylized front elevation illustration of the position of the rotary antenna at the time of transmitting successive pulses.

An example is illustrated in FIG. 3. Therein, the radius of rotation of the center of the beam, is for instance, three feet. Each beam is one foot in diameter. At a rotation rate of 60 rpm, which is one rotation per second, a pulse issued every 0.05 seconds (20 Hz) will be advanced 20° from the next preceding pulse, thereby providing 18 different positions without overlap. Of course, other parameter values may be chosen to suit any implementation of the present invention.

The invention may also be practiced by having, for instance, 4.44 revolutions of the antenna for each 18 pulses (266.4), whereby the beams in each revolution would be separated by 80° instead of 20°, and beams in one revolution would be separated by 40° from beams in alternative revolutions, resulting in a greater distance from the transmitter before any significant overlap occurs, and thereby providing additional reduction in thermal blooming. Other relative relationships between antenna rotation speed and pulse repetition rate or frequency may, of course, be chosen to suit any implementation of the present invention.

The center of the concave mirror 29 is displaced radially outward of the center of the convex mirror 27 by three times the diameter of the laser beam. If, due to physical constraints, the center of the concave mirror 29 ended up being only two beam diameters radially outward of the center of the convex mirror 27, then rotating the optical antenna at a greater multiple of the pulse repetition rate of the laser (as described hereinbefore) can achieve the same degree of separation. Similarly, if a greater radial distance is achieved, so as to provide additional pulse positions (as the 18 positions in FIG. 3 are referred to), then the frequency of rotation can be a lower multiple of the laser pulse repetition frequency to achieve the same degree of separation.

The advantage is that the invention allows having repetition rates which are, for instance in these examples, 20 or 80 times (or more) greater than they could be without the rotary optical antenna of the present invention. This provides a proportional increase in the fluence at the target for the same degree of blooming. The invention may also be used to advantage with CW lasers, the slewing of the beam position providing a significant reduction of thermal blooming. The path of the point where laser energy is transmitted (the position of the second mirror 29 in the exemplary embodiment herein) need not be circular; it could be any shape of closed path to suit a given implementation of the invention, which spreads the heating so as to reduce thermal blooming.

As used herein, the center of each mirror is defined as the center of the point of impingement of a laser beam on that mirror in the arrangement of the invention, rather than the topological center of a mirror piece.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A high power laser system minimizing thermal blooming of the laser beam, comprising:

a high powered pulse laser having a pulse repetition frequency and providing laser beams;

a rotating structure having an axis and including first and second mirrors, said first mirror centered on said axis and in the path of said laser beams and reflecting said laser beams toward said second mirror, said second mirror providing output laser beams, the center of said second mirror being displaced radially outward from the center of said first mirror by at least twice the diameter of said laser beam; and means for rotating said structure at a rotary speed relative to said pulse repetition frequency so that the paths of successive ones of said output laser beams do not overlap as they emerge from said system.

2. A system according to claim 1 wherein:

said first mirror is movable along said axis thereby to adjust the range to a point where said beams converge.

3. A system according to claim 1 wherein:

said laser has a pulse repetition rate of 20 Hz.

4. A system according to claim 3 wherein:

said structure rotates at 60 RPM.

5. A system according to claim 3 wherein:

said structure rotates at 266.4 RPM.

* * * * *